United States Patent [19]

Petrus

[11] 4,353,865

[45] Oct. 12, 1982

[54] BORON CONTAINING, IRON-MANGANESE-ZIRCONIUM MASTER-ALLOY

[76] Inventor: Alex E. Petrus, 3560 Ridge Rd., Cleveland, Ohio 44102

[21] Appl. No.: 257,216

[22] Filed: Apr. 24, 1981

[51] Int. Cl.[3] ..... C22C 16/00; C22C 22/00; C22C 30/00

[52] U.S. Cl. ..... 420/422; 420/434; 420/581

[58] Field of Search ..... 75/134 F, 134 N, 123 B, 75/123 H, 123 N, 177, 134 M, 28, 43, 48, 53

[56] References Cited

U.S. PATENT DOCUMENTS 4,116,682 9/1978 Polk et al. ..... 75/123 H
4,311,523 1/1982 Luycky ..... 75/53 X

*Primary Examiner*—L. Dewayne Rutledge
*Assistant Examiner*—David A. Hey

[57] ABSTRACT

This invention relates to special ferromanganese type master-alloys, such as normally are added to steels during the process of melting and/or deoxidation, except that in the new master-alloy substantial amounts of zirconium and boron are added to make the new material especially suitable as an addition for boron in various boron-containing steels.

A typical aim composition for the new Fe-Mn-Zr-B master-alloy would be about 20% Fe, about 40% Mn, about 35% Zr, about 2.5% B, about 2.0% C, and the balance residual elements with preferably not more than about 0.5% Al. It can be noted that the ratio of the Zr to the B contents is about 14:1. This means that for a steel addition of 0.0025% B, an amount of 0.035% Zr would be available in the steel to enhance the hardenability contribution of the B to the steel and to prevent "fading" of the boron during the heating operations.

4 Claims, No Drawings

BORON CONTAINING, IRON-MANGANESE-ZIRCONIUM MASTER-ALLOY

BACKGROUND OF THE INVENTION

Numerous ferro-alloys are available to be used as additions to basic steel metals of either the carbon steel types, low alloy steel types, high-strength low-alloy (HSLA) types, and even stainless steels and other special steel types. Typical examples would be ferrovanadium, ferrotitanium, ferrocolumbium, ferroboron, and numerous other boron-containing master-alloys, including "Grainal 79". The latter has a nominal composition of Fe- 20 Ti- 13 Al- 4 Zr- 0.50 B and is used effectively as a boron addition to air-melted steels which are poured into a ladle. The aluminum contained in this material acts as an effective deoxidizer to the steel to protect the Ti, Zr, and B from burning up in the molten metal. They are thus retained in the steel to improve the hardenability of the metal. Both the Ti and Zr also act as deoxidants in the steel to some extent, just as Al, but their primary utility is to prevent "fading" of the boron effect on hardenability when the ingots, slabs, or billets are heated to as high as 2350 F. for processing.

Even at heating temperatures of 2200 F. for prolonged periods of time up to only 12 hours, the elements of vanadium, columbium, and aluminum have been shown to be ineffective in retaining the boron effect on hardenability. Only Ti and Zr have been proven to be highly effective in this application.

From evaluating the existing prior art with response to the addition of boron to various steels, it can easily be noted that some limitations exist in the use of the presently available ferro-alloys and master-alloys, including the two most commonly used, ferro-boron and "Grainal 79". These materials will, therefore, be discussed in comparison with the advantages which are claimed for the Fe- Mn- Zr -B master-alloy of the present invention.

In their broadest conception, the master-alloys of the present invention would include the following elements in the ranges indicated:

| Fe | Mn | Zr | B | C | Sn | Al | Others |
|---|---|---|---|---|---|---|---|
| 5 | 10 | 5 | 0.1 | 0.1 | 1.5 | 1.0 | 1.0 |
| 50 | 60 | 55 | 10.0 | 5.0 | max. | max. | max. |

It is conceivable that some variations for the various elements outside of the limits set above could be utilized in a master-alloy of this general type without departing from the conceptual considerations involved in its use as an alloying addition to boron steels. One primary aspect of this invention, however, would be to keep the ratio of the Zr to the B at about 14:1, or preferably in the range of between 10:1 and 20:1 so that sufficient Zr would be present in the boron steel melt in relation to the amount of boron to prevent the hardenability effect of the boron from "fading".

For the preferred embodiment of the invention, which would result in an optimum utilization of the Zr and B in the master-alloy as added to the molten steel, the following ranges of alloy content would be most desirable. These preferred ranges are also based on some general processing, and also some economic considerations with respect to producing the alloy:

| Fe | Mn | Zr | B | C | Sn | Al | Others |
|---|---|---|---|---|---|---|---|
| 15 | 30 | 25 | 2.0 | 0.1 | 0.5 | 0.5 | 0.5 |
| 30 | 50 | 40 | 3.5 | 2.5 | max. | max. | max. |

It would also be new and novel if other elements normally found in alloy steels, such as Si, Ni, Cr, Mo, or Cu would be present in the above described master-alloys in any large percentages, even in percentages of as high as 5%, or even 10% or more. Such variations could still be considered within the basic concept and scope of the new invention.

Some preferred alloy compositions within the scope of the preferred alloy ranges are as follows:

A. 20 Fe- 40 Mn- 35 Zr- 2.5 B- 2.0 C

B. 27 Fe- 35 Mn- 30 Zr- 3.0 B- 1.5 C

Competitive master-alloys containing boron include the following:

C. Ferroboron: Fe- 17.5 B

D. "Grainal 79": Fe- 20 Ti- 13 Al- 4 Zr- 0.5 B

It can be seen from the above indicated compositions that the Ferroboron, while containing substantially higher boron content than the preferred alloys of the new invention, does not contain any amount of either of the two desired elements, Ti and Zr, as a part of its base composition. Also, no elements are present in the Ferroboron to act as deoxidizers to protect the boron from burning up in a steel melt.

With respect to the "Grainal 79", the following important differences and considerations must be noted in any comparison of the two materials:

A. The new master-alloy contains only Zr, and no Ti, for stabilizing the boron in the steel heats. This is preferable because the Zr does not have as great a tendency to form detrimental carbides or carbonites in the steel as does Ti.

B. A steel heat should not have to be deoxidized with Al before the addition of the new master-alloy as a boron addition to the melt because it has its own powerful deoxidizing agents included in its composition, namely Mn, together with small amounts of C, Si, and even 0.5% Al, which should act to prevent the Zr and B from being oxidized.

C. The new master-alloy does not contain Al or Ti, as does "Grainal 79", which form two of the most detrimental oxides affecting the machinability of steels.

D. The new master-alloy contains about five times the amount of B as does "Grainal 79". This means that only about one-fifth of the amount of "Grainal 79" previously used in a steel heat would have to be used to obtain the same amount of boron, so that the temperature of the bath would be reduced considerably less during melt-in.

E. Zirconium, in addition to being one of the preferred elements to stabilize the hardenability effect of boron, also is the preferred element for sulfide shape control in steels to improve their machinability.

The above noted combination of factors pertinent to the use of the new master-alloy as a boron addition to steel also describes the new and novel features of the invention.

What is claimed:

1. A New Master-alloy composition for the addition of Boron to Steels comprised of the following broad ranges of alloying elements, including 5.0 to 50.0% Iron, 10.0 to 60.0% Mn, 5.0 to 55% Zr, 0.1 to 10.0% B, 0.1 to 5.0% C, with the balance residual elements in small percentages of less than 1.5%.

2. A New Master-alloy composition for the addition of Boron to Steels comprised of the following preferred ranges of alloying elements, including 15.0 to 30.0% Fe, 30.0 to 50.0% Mn, 25.0 to 40.0% Zr, 2.0 to 3.5% B, 0.1 to 2.5% C, with the balance residual elements in small percentages of less than 1.5%.

3. A New Master-alloy composition according to claim 1, wherein the ratio of Zr to B is within the range of the ratios of 10:1 to 20:1.

4. A New Master-alloy composition according to claim 2, wherein the ratio of Zr to B is about 14:1.

* * * * *